United States Patent [19]
Mumford et al.
[11] 4,402,416
[45] Sep. 6, 1983

[54] CHILD-RESISTANT PACKAGE

[75] Inventors: George V. Mumford, Toledo; Ned J. Smalley, Perrysburg, both of Ohio

[73] Assignee: Owens-Illinois, Inc., Toledo, Ohio

[21] Appl. No.: 371,644

[22] Filed: Apr. 26, 1982

[51] Int. Cl.[3] ..... B65D 55/02
[52] U.S. Cl. ..... 215/220
[58] Field of Search ..... 215/217, 218, 219, 220

[56] References Cited

U.S. PATENT DOCUMENTS 3,669,294 6/1972 Petrohelli et al. ..... 215/220
3,918,602 11/1975 McIntosh ..... 215/220
4,011,960 3/1977 Maurernay et al. ..... 215/220

*Primary Examiner*—George T. Hall
*Attorney, Agent, or Firm*—J. R. Nelson; M. E. Click

[57] ABSTRACT

A child-resistant package comprising a container having a neck with threads thereon and a child-resistant closure. The closure comprises a cap made of organic plastic material and having a top wall and a peripheral skirt, having threads thereon adapted to engage the threads of the container. The skirt has a radial flange and a plurality of circumferentially spaced depressions on the upper surface of the radial flange. The closure also comprises a ring telescoped over the cap and surrounding the skirt of the cap. The ring has a plurality of lugs extending upwardly from the radial flange of the cap and adapted to engage the depressions upon application of a downward force on the ring. Each depression on the radial flange has a substantially vertical surface at one circumferential end adapted to be engaged by a lug on the ring when the ring is rotated in a direction to thread the closure onto the container. Each depression on the radial flange of the closure also has an inclined surface at the other circumferential end such that upon mere rotation of the ring in a direction to unthread the closure from the container results in the lugs on the ring sliding up the inclined surfaces so that the closure can only be removed by a combined downward force on the ring and rotational force in the direction of threading the closure off of the container.

20 Claims, 7 Drawing Figures

CHILD-RESISTANT PACKAGE

This invention relates to child-resistant packages.

BACKGROUND AND SUMMARY OF THE INVENTION

In one type of child-resistant package used for packaging products that might be harmful to children, two piece closures are provided, one part of the closure being adapted to be threaded onto and off of the container and the other part of the closure being constructed and arranged so that the two parts must be operated in a particular fashion in order to remove the closure rather than merely rotating the part that is grasped.

Among the objects of the present invention are to provide a child-resistant package which comprises a plastic closure which will effectively provide a child-resistant feature; wherein the parts can be readily removed from a mold without having complex molds; wherein the child-resistant construction is sturdy enough to withstand numerous openings and closings, top loading and abuse without impairing the child-resistant feature; wherein the closure is constructed and arranged so that the only driving access is through rotation of the ring and manipulation thereof in an unscrewing direction; and wherein the closure will readily retain a liner.

In accordance with the invention, the child-resistant package comprises a container having a neck with threads thereon and a child-resistant closure. The closure comprising a cap made of organic plastic material and having a top wall and a peripheral skirt. The skirt has threads thereon adapted to engage the threads of the container. The skirt has a radial flange and a plurality of circumferentially spaced depressions on the upper surface of the radial flange. The closure also comprises a ring telescoped over the cap and surrounding the skirt of the cap. The ring has a plurality of lugs extending upwardly from the radial flange of the cap and adapted to engage the depressions upon application of a downward force on the ring. Each depression on the radial flange having a substantially vertical surface at one circumferential end adapted to be engaged by a lug on the ring when the ring is rotated in a direction to thread the cap onto the container. Each depression on the radial flange of the closure also has an inclined surface at the other circumferential end such that upon mere rotation of the ring in a direction to unthread the closure from the container results in the lugs on the ring sliding up the inclined surfaces so that the closure can only be removed by a combined downward force on the ring and rotational force in the direction of threading the closure off of the container.

DESCRIPTION

Figure 1:
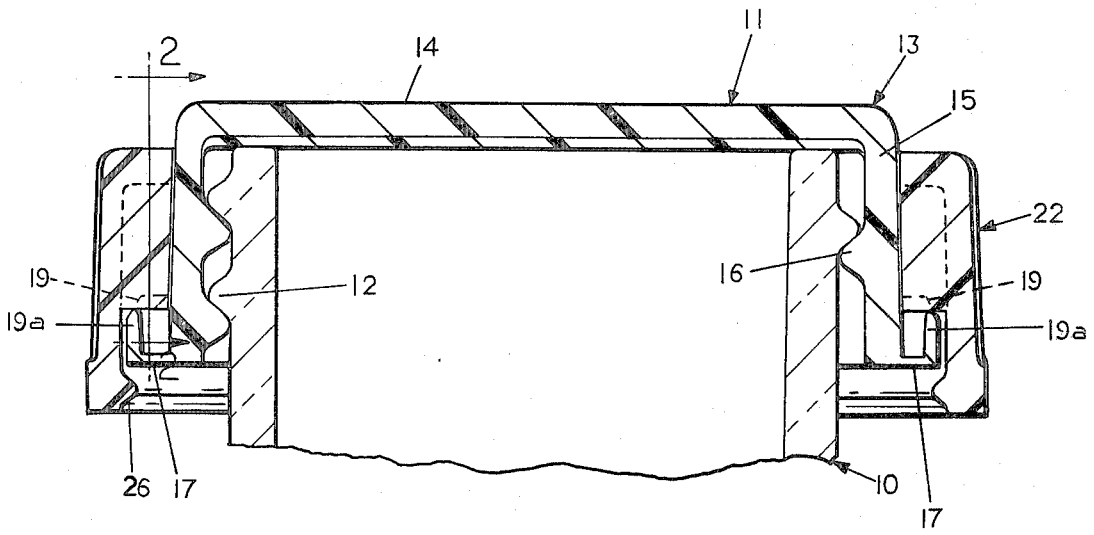
FIG. 1 is a fragmentary vertical sectional view through a package embodying the invention.

Referring to FIG. 1, the child-resistant package embodying the invention comprises a container 10 of glass or plastic and a closure 11. The container 10 includes threads 12 adapted to receive the closure, as presently described.

The closure 11 comprises a cap 13 having a top wall 14 and a peripheral wall or skirt 15 with threads 16 engaging the threads 12 of the container.

Figure 2:
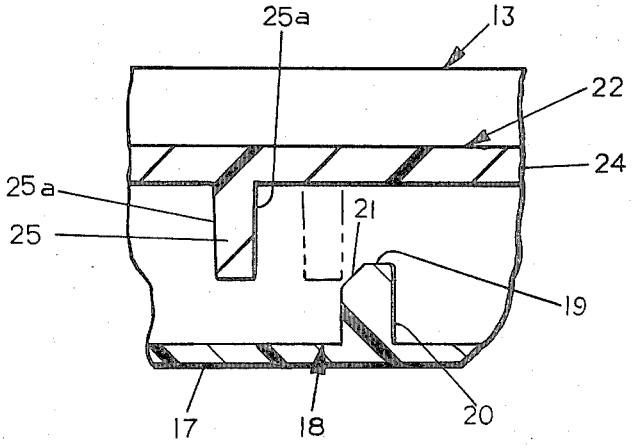
FIG. 2 is a fragmentary sectional view on an enlarged scale taken along the line 2—2 in FIG. 1.
Figure 3:
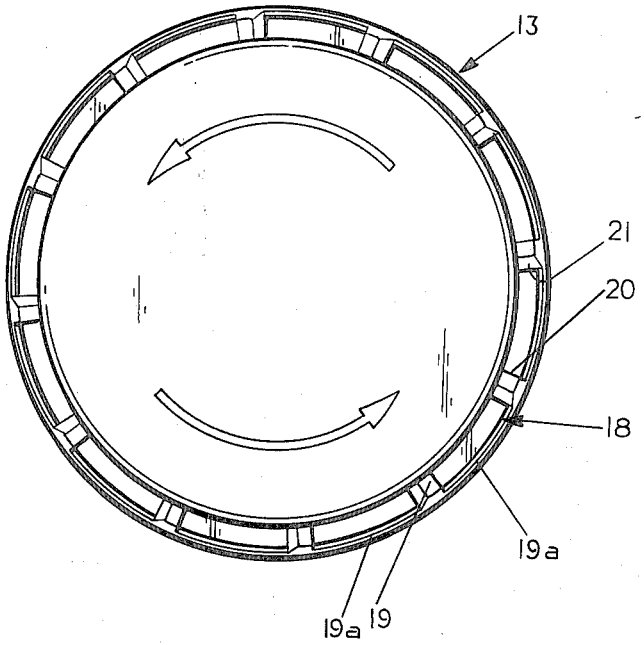
FIG. 3 is a plan view of a cap that forms part of the closure.
Figure 4:
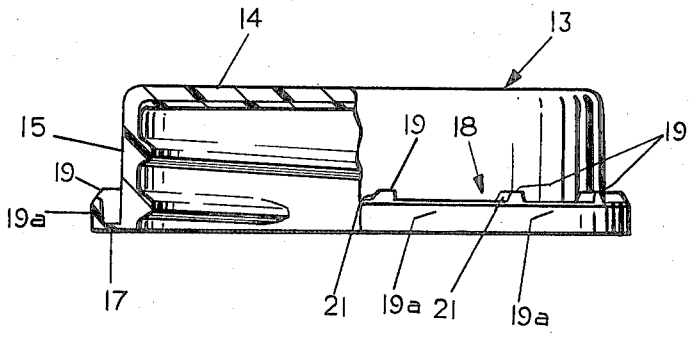
FIG. 4 is a part sectional elevational view of a portion of the closure.
Figure 5:
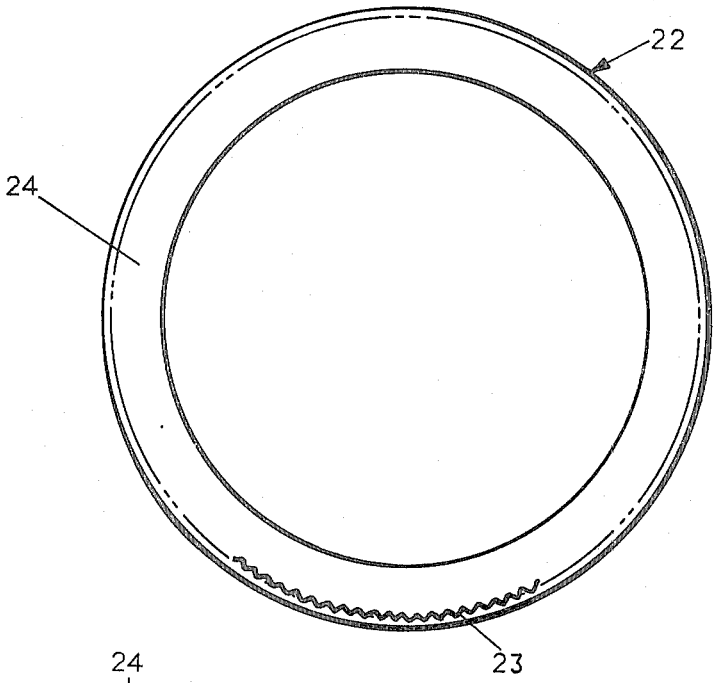
FIG. 5 is a top plan view of the ring that forms part of the closure.
Figure 6:
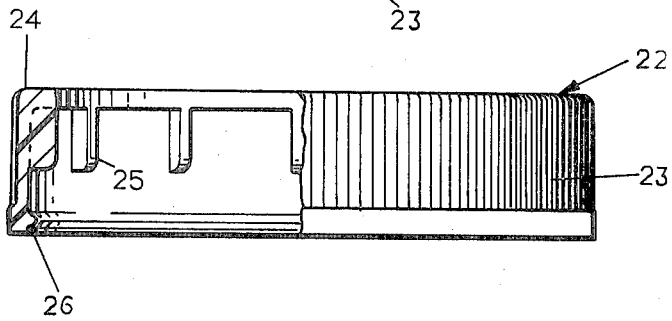
FIG. 6 is a fragmentary part sectional elevational view of the ring.
Figure 7:
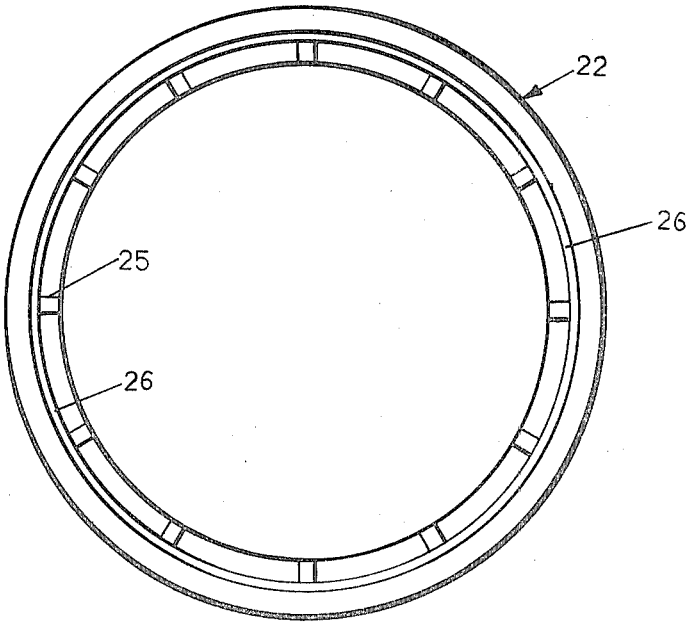
FIG. 7 is a bottom plan view of the ring.

As shown in FIGS. 3 and 4, the cap 13 further includes a radial flange 17 extending outwardly from the lower edge of the peripheral skirt 15. The upper surface of the flange 17 is formed with a plurality of circumferentially spaced depressions 18 defined by upstanding lugs 19. The lugs 19 have a substantially greater circumferential extent than the depressions 18 and are spaced radially outwardly from skirt 15. Each recess or depression 18 includes a substantially vertical surface 20 at one circumferential end and an inclined surface 21 at the other end. The circumferential length of each depression 18 is greater than the depth of each depression and each lug 25 has a thickness substantially less than the circumferential length of each depression 18 (FIG. 2). The substantially vertical surface 20 of each depression 18 preferably forms an angle of approximately 1° with the vertical. The inclined surface 21 of each depression 18 preferably forms an angle of approximately 50° with the vertical. A liner 14*a* is provided on the undersurface of top wall 14.

The closure 11 further includes a ring 22 which telescopes over the peripheral wall 15 of the cap and comprises a peripheral wall 23 having exterior serrations for facilitating grasping of the ring and a radial wall 24 that extends radially inwardly toward the skirt or wall 15 of the cap 13. The inner surface of the ring 22 is provided with a plurality of axially extending lugs 25 of substantially uniform circumferential thickness that extend from both the peripheral wall 23 and the radial wall 24, the number of lugs 25 corresponding to the number of depressions 18. The ring 22 further includes a bead 26 that snaps over and extends below the flange 17 to hold the ring 22 on the cap. The side walls 25*a* of each lug 25 preferably form an angle of approximately 1° to the vertical.

The ring 22 surrounds the entire outer surface of the peripheral skirt 15 so that the only exposed surface for readily grasping and rotating the closure is by way of the ring 22. The flange 17 and skirt 15 surfaces are covered and inaccessible for biting or prying by the use of tools by a child of tender years in an attempt to rotate the closure. Rotation of the cap 13 is thus only through driving engagement of the lugs 25 on the ring 22 and the depressions 18 on the cap 13.

The cap 13 and ring 22 are preferably made of organic plastic material such as polypropylene.

In use, the cap 13 and ring 22 are assembled and when it is desired to place them on the container, the ring 22 is grasped and rotated. Only a slight downward force on the ring 22 is required to bring the lugs 25 into engagement with the depressions and as the ring is rotated, the lugs engage the first substantially vertical surfaces 20 so that the closure is readily threaded onto the container (FIG. 2).

However, once the closure is threaded on the container, a normal rotation of ring 22 in a direction to unthread the closure will cause the lugs 25 to ride up the inclined surfaces 21 sliding past the surfaces so that the closure is not removed. A combined substantial downward force and rotational force are required on ring 22 to remove the closure which combined forces are difficult if not impossible for the average child to perform.

It can thus be seen that there has been provided a child-resistant closure which is effective; which is made of plastic parts that are study enough to withstand numerous openings and closings, top loading or abuse without losing the child-resistant features; and which parts are constructed such that they can be readily removed from a core of molding apparatus without major mold costs such as inserts and the like; and wherein the liner is readily retained by the threads.

We claim:

1. A child-resistant package comprising a container having a neck with threads thereon and a child-resistant closure, said closure comprising a cap made of organic plastic material and having a top wall and a peripheral skirt, said skirt having threads thereon adapted to engage the threads of the container, said skirt having a radial flange and a plurality of circumferentially spaced depressions on the upper surface of the radial flange, and a ring telescoped over the cap and surrounding the skirt of the cap, said ring having a plurality of lugs on both the radial and peripheral walls of the closure and adapted to engage the depressions at times upon application of a downward force on the ring, each depression on the radial flange having a substantially vertical surface at one circumferential end adapted to be engaged by a lug on the ring when the ring is rotated in a direction to thread the closure onto the container, each depression on the radial flange of the closure having an inclined surface at the other circumferential end such that upon mere rotation of the ring in a direction to unthread the closure from the container results in the lugs on the ring sliding up the inclined surfaces so that the closure can only be removed by a combined downward force on the ring and rotational force in the direction of threading the closure off of the container.

2. The child-resistant package set forth in claim 1 wherein said ring has a radially inwardly extending bead projecting below the outer edge of the radial flange of the cap to hold the ring in assembled relation on the cap.

3. The child-resistant package set forth in claim 1 wherein said depressions on the radial flange of the closure have a circumferential length greater than the depth of the depression.

4. The child-resistant package set forth in claim 3 wherein said lugs on said ring have a thickness in a circumferential direction substantially less than the circumferential length of the depression.

5. The child-resistant package set forth in claim 1 wherein said ring includes a radially extending wall overlying the radial flange on the closure.

6. The child-resistant package set forth in claim 5 wherein said lugs extend radially inwardly from the peripheral wall of said ring and the radial wall of said ring.

7. The child-resistant closure set forth in claim 1 wherein the substantially vertical surface of each depression extends at an angle of not more than approximately 1° to the vertical.

8. The child-resistant package set forth in claim 1 wherein the inclined surface of each depression extends at an angle of at least approximately 50° to the vertical.

9. The child-resistant package set forth in claim 1 wherein the ring has a peripheral portion substantially surrounding said skirt of said cap such that gripping surface access of the skirt and flange of the cap are precluded and the cap can only be rotated by grasping and rotating the ring.

10. The child-resistant package set forth in claim 1 wherein the ring also is characterized by covering the peripheral skirt such that gripping surface access of said skirt and its said flange is covered whereby, the only way to rotate the skirt is grasping and rotating the ring.

11. A child-resistant closure for use on a container having a neck with threads thereon comprising a cap made of organic plastic material and having a top wall and a peripheral skirt, said skirt having threads thereon adapted to engage the threads of a container, said skirt having a radial flange and a plurality of circumferentially spaced depressions on the upper surface of the radial flange, and a ring telescoped over the cap and surrounding the skirt of the cap, said ring having a plurality of lugs overlying the radial flange of the closure and adapted to engage the depressions upon application of a downward force on the ring, each depression on the radial flange having a substantially vertical surface at one circumferential end adapted to be engaged by a lug on the ring when the ring is rotated in a direction to thread the closure onto the container, each depression on the radial flange of the closure having an inclined surface at the other circumferential end such that upon mere rotation of the ring in a direction for unthreading the closure from the container results in rotation of the ring about the closure and the lugs on the ring sliding up the inclined surfaces so that the closure can only be removed by a combined downward force on the ring for driving engagement with the flange and rotational force in the direction of threading the closure off of the container.

12. The child-resistant closure set forth in claim 11 wherein said ring has a radially inwardly extending bead projecting below the outer edge of the radial flange of the cap to hold the ring in assembled relation on the cap.

13. The child-resistant closure set forth in claim 11 wherein said depressions on the radial flange of the closure have a circumferential length greater than the depth of the depression.

14. The child-resistant closure set forth in claim 12 wherein said lugs on said ring have a thickness in a circumferential direction substantially less than the circumferential length of the depression.

15. The child-resistant closure set forth in claim 12 wherein said ring includes a radially extending wall overlying the radial flange on the closure.

16. The child-resistant closure set forth in claim 15 wherein said lugs extend radially inwardly from the peripheral wall of said ring and the radial wall of said ring.

17. The child-resistant closure set forth in claim 11 wherein the substantially vertical surface of each depression extends at an angle of approximately 1° to the vertical.

18. The child-resistant closure set forth in claim 11 wherein said inclined surface of each depression extends at an angle of approximately 50° to the vertical.

19. The child-resistant closure set forth in claim 11 wherein the ring has a peripheral portion substantially surrounding said skirt of said cap such that gripping surface access of the skirt and flange of the cap are precluded and the cap can only be rotated by grasping and rotating the ring.

20. The closure set forth in claim 11 wherein the ring also is characterized by covering the peripheral skirt such that gripping surface access of said skirt and its said flange is covered whereby the only way to rotate the skirt is by grasping and rotating the ring.

* * * * *